US007635131B2

(12) United States Patent
Fukazawa et al.

(10) Patent No.: US 7,635,131 B2
(45) Date of Patent: Dec. 22, 2009

(54) PRIZE ACQUIRING GAME APPARATUS

(75) Inventors: Mitsuharu Fukazawa, Tokyo (JP); Takashi Yamamoto, Tokyo (JP); Kouki Takasugi, Tokyo (JP)

(73) Assignee: Sega Corporation, Tokyo (JP)

( * ) Notice: Subject to any disclaimer, the term of this patent is extended or adjusted under 35 U.S.C. 154(b) by 212 days.

(21) Appl. No.: 11/245,975

(22) Filed: Oct. 7, 2005

(65) Prior Publication Data

US 2006/0094489 A1 May 4, 2006

(30) Foreign Application Priority Data

Oct. 29, 2004 (JP) ..... 2004-317111

(51) Int. Cl.
*A63F 9/24* (2006.01)
*G07F 11/00* (2006.01)

(52) U.S. Cl. ..... 273/447; 221/192

(58) Field of Classification Search ..... 273/447, 273/448; 700/231
See application file for complete search history.

(56) References Cited

U.S. PATENT DOCUMENTS 4,456,147 A * 6/1984 Tominaga ..... 221/67
4,561,564 A * 12/1985 Negishi ..... 221/64
5,848,726 A * 12/1998 Yajima et al. ..... 221/150 HC
5,855,374 A * 1/1999 Shoemaker, Jr. ..... 273/447
6,019,246 A * 2/2000 Yajima et al. ..... 221/2
6,155,455 A * 12/2000 Yajima et al. ..... 221/97
6,283,475 B1 * 9/2001 Stubben ..... 273/448
6,428,008 B1 * 8/2002 Singer ..... 273/447
6,598,881 B1 * 7/2003 Shoemaker, Jr. ..... 273/447
6,921,076 B1 * 7/2005 Norton ..... 273/447
2002/0077724 A1 * 6/2002 Paulucci et al. ..... 700/231
2005/0218602 A1 * 10/2005 Watanabe et al. ..... 273/447
2006/0170164 A1 * 8/2006 Watanabe ..... 273/447
2007/0029734 A1 * 2/2007 Fukazawa et al. ..... 273/447
2007/0114725 A1 * 5/2007 Peck et al. ..... 273/447

FOREIGN PATENT DOCUMENTS

JP 7-13756 4/1995
JP 07157090 * 6/1995

* cited by examiner

*Primary Examiner*—Peter DungBa Vo
*Assistant Examiner*—Masud Ahmed
(74) *Attorney, Agent, or Firm*—Wenderoth, Lind & Ponack, L.L.P.

(57) ABSTRACT

The prize acquiring game apparatus has operation unit that is operated by a player, a prize storage section that stores a plurality of prizes therein, prize acquiring that acquires the prizes, an outlet that is provided into the prize storage section and from which the prizes is discharged outside of the prize storage section, control unit that operates the prize acquiring unit in response to an operation signal from the operation unit, a discharged prize storage section that stores the prizes discharged from the outlet by the prize acquiring unit operated according to the control of the control unit, a passage that is constituted so that the prizes discharged from the outlet can reach the discharge prize storage section, and buffer unit that is arranged to the discharged prize storage section and absorbs impact of the prizes falling via the passage.

4 Claims, 12 Drawing Sheets

RESULTS OF FALL TEST MEASUREMENT

1) CONTENTS OF THE FALL TEST: An impact value is measured when a prize (275 g) is allowed to freely fall from a height of 950 mm (distance from UFO to a floor of a shooter)

2) RESULTS OF FALL TEST:

- At the time when the floor of the shooter is a steel plate (normal) impact value: 311 G top: polyvinyl chloride leather sheet (thickness: 1 mm)
  middle: hardness of urethane sponge: 85 N (thickness: 10 mm)
  bottom: vinyl chloride leather sheet (thickness: 1 mm)

- three-layered structure impact value: 179 G top: vinyl chloride leather sheet (thickness: 1 mm)
  bottom: hardness of urethane sponge: 85 N (thickness: 10 mm)

- two-layered structure impact value: 263 G

3) THE OTHER OBJECTS TO BE TESTED
all impact values in the combination of vinyl chloride leather sheet (thickness: 1 to 2 mm) and urethane sponge (thickness: 5 to 9 mm): about 300 G

FIG. 7

PRIZE ACQUIRING GAME APPARATUS

FIELD OF THE INVENTION

The present invention relates to a prize acquiring game apparatus that moves an acquiring unit in a housing so as to acquire prizes. The invention particularly relates to the prize acquiring game apparatus that has a unit which absorbs impact on a falling surface at the time when a prize is allowed to fall so as to be discharged out of the housing.

BACKGROUND OF THE INVENTION

Prize acquiring game apparatuses such as crane game machines whose object is to acquire prizes stored in a housing provide interest of an operation, and use prizes of popular characters or the like so as to give challenge incentive to players. For this reason, a lot of these apparatuses are installed in general stores, shopping malls as well as game arcades. Conventionally various prize acquiring game apparatuses are proposed.

In such type of game apparatuses, a gripping section with arms (grip claws) which are freely opened/closed is provided in game space surrounded by transparent plate or semispheric shaped members so as to freely move to an arbitrary position and freely move up and down, and grabs prizes placed in the game space. In order to grab the prizes placed in the game space, a player operates operation buttons provided to an operation panel of the game apparatus so as to move the gripping section in a horizontal plane and locate the gripping section with respect to a desired prize. The player stops the gripping section in that position, allows the gripping section to automatically fall so as to grab the desired prize by means of the arms. The player allows the gripping section which grabs the prize to be automatically raised to a predetermined height by means of an elastic biasing force of the arm section and moves the gripping section in this state to a position just above the outlet in a horizontal plane. Thereafter, the arms are opened so that the prize is released and freely falls to the outlet. The prize which enters the outlet fall, is stored in a bottom portion of a discharged prize storage section below the outlet, and taken out from a prize ejecting port of the discharged prize storage section. In this state, one game is ended (for example, see Japanese Utility Model Application Publication 7-13756).

SUMMARY OF THE INVENTION

As described above, a prize acquiring game apparatus such as a crane game machine raises a prize grabbed by an arm section to a predetermined height and moves a gripping section in this state to a position above an outlet in a horizontal plane so as to be freely dropped from this height to the outlet. At this time, when the position where the prize is grabbed is not proper, the prize does not enter the outlet and is dropped out of the outlet, thereby disabling the acquisition of the prize. Such a form increases a difficulty level of the acquisition of prizes, thereby giving challenge incentive to a player.

The apparatus has an advantage that the difficulty level of the acquisition of prizes increases, but since a distance from a position where a prize is released to a fall position of the discharged prize storage section is long, some types of prizes are damaged or broken due to fall impact. For this reason, in the conventional prize acquiring game apparatuses, types of the prizes are limited, breakables (earthwares and glass products), goods whose surfaces are easily damaged, precision apparatuses which are easily defected by a shock and the like cannot be used as prizes.

The present invention is devised in order to solve the above problems, and its object is to provide a prize acquiring game apparatus that can treat goods such as the breakables, the goods to be easily damaged and precision apparatuses which are vulnerable to impact as well as stuffed animals and dolls which have resistance to impact at the time of fall as prizes which can be acquired in a game.

The present invention relates to a prize acquiring game apparatus that moves an acquiring unit in a housing so as to acquire prizes, and an object of the present invention is achieved by including: operation means that is operated by a player; a prize storage section that stores a plurality of prizes therein; prize acquiring means that acquires the prizes; an outlet that is provided in the prize storage section and through which the prizes are discharged to the outside of the prize storage section; control means that controls the prize acquiring means to be operated in response to an operation signal from the operation means; a discharged prize storage section that stores the prizes discharged from the outlet by the prize acquiring means operated based on the control of the control means therein; a passage that is constituted so that the prizes discharged from the outlet can reach the discharged prize storage section; and buffer means that is arranged in the discharged prize storage section and absorbs impact of the prizes falling via the passage.

Further, the present invention is achieved more effectively by that the buffer means is composed of: a rigid body having rigidity; an elastic body having elasticity which is overlapped with the rigid body; and a fixing unit that fastens and fixes a part of the rigid body into the discharged prize storage section, the elastic body is constituted so that first and second elastic bodies with different impact absorptive forces are laminated, the rigid body or the second elastic body, or the rigid body and the second elastic body have a notched portion obtained by notching a part of its end, the first elastic body overlapped with the second elastic body is constituted so as to cover a portion corresponding to the notched portion, the prize acquiring means has: a prize gripping unit that grips the prize stored in the prize storage section; a lateral direction moving unit that moves the prize gripping unit to a lateral direction with respect to a player opposed to the game apparatus; a depthwise direction moving unit that moves the prize gripping unit to a depthwise direction; and an up-down direction moving unit that moves the prize gripping section to an up-down direction, the control means, when receiving a detected signal from a detecting unit for detecting that the prize gripping unit is above the outlet, operates the up-down direction moving unit to move the prize gripping unit to the down direction, and then control to release the gripping of the prize.

The above object of the present invention is achieved by including: a prize storage section that stores a plurality of prizes therein; a prize gripping unit that has a gripping section which can grip and release the prizes by means of an open/close operation of arms and can be freely moved to horizontal and vertical directions in an internal space of the prize storage section; operation means for a player that can move the gripping section of the prize gripping unit to a lateral direction and a depthwise direction with respect to the player opposed to the game apparatus; control means that starts a movement of the gripping section in response to an operation signal from the operation means and moves the gripping section to the lateral direction, the depthwise direction and an up-downward direction in the prize storage section; a discharge prize storage section that is provided below the prize storage section and stores a prize falling into frame body of the outlet; and buffer means that has a buffer unit, which is constituted so that a thin plate-shaped rigid body is laminated below a buffer layer obtained by overlapping plural types of elastic bodies with different impact absorptive forces with one another and so that an end of the rigid body is covered with one of the plural elastic bodies, and absorbs impact of the prizes falling from the outlet of the prize storage section by means of the buffer unit provided to a bottom portion of the discharged prize storage section.

Further, the object of the present invention is achieved more effectively by that the discharged prize storage section is provided with the buffer unit above its bottom surface, and is provided with a cover body which covers an opening on its front surface and a wall portion which defines a depth of a storage space on a surface opposite to the cover body, the rigid body of the buffer unit is fitted into a fitting portion provided to the wall portion, and is provided with a protrusion portion protruded to an end of the wall portion and a fixing portion, which fixes the buffer unit to the bottom surface, on the side of the cover body. The rigid body of the buffer unit has a notched portion obtained by notching a part of the end. The elastic body of the buffer unit is constituted so that first and second elastic bodies with different impact absorptive forces are laminated, the rigid body or the second elastic body, or the rigid body and the second elastic body have the notched portion obtained by notching a part of the end, and the first elastic body overlapped with an upper portion of the second elastic body covers a portion corresponding to the notched portion, and when both the rigid body and the second elastic body have the notched portion, the notched portion of the rigid body is overlapped with the notched portion of the second elastic body at least partially in a state that the rigid body is overlapped with the elastic body.

According to the present invention, since the buffer means that absorbs the impact of the prizes falling from the outlet is provided, breakables, goods easily damaged, and goods such as precision apparatuses which is less resistant to the impact can be treated as the prizes which can be acquired in the game. Further, the buffer means is composed of the buffer unit which can be detachable to the prize fall portion, thereby facilitating addition and replacing operations of the buffer means in the existent prize acquiring game apparatuses. Further, when urethane sponge and vinyl chloride leather sheet is used as the buffer member, the prize acquiring game apparatus which is inexpensive and has the buffer means with excellence in impact absorptive force and durability can be provided. Further, the control means has a fall distance adjusting function that lowers the prizes to a position near the outlet so as to fall, thereby further absorbing the impact of the fallen prizes.

BRIEF DESCRIPTION OF THE DRAWINGS

FIG. 7 is a diagram showing results of testing impact absorptive force and durability of the buffer member;

DETAILED DESCRIPTION OF THE PREFERRED EMBODIMENTS

Figure 1:
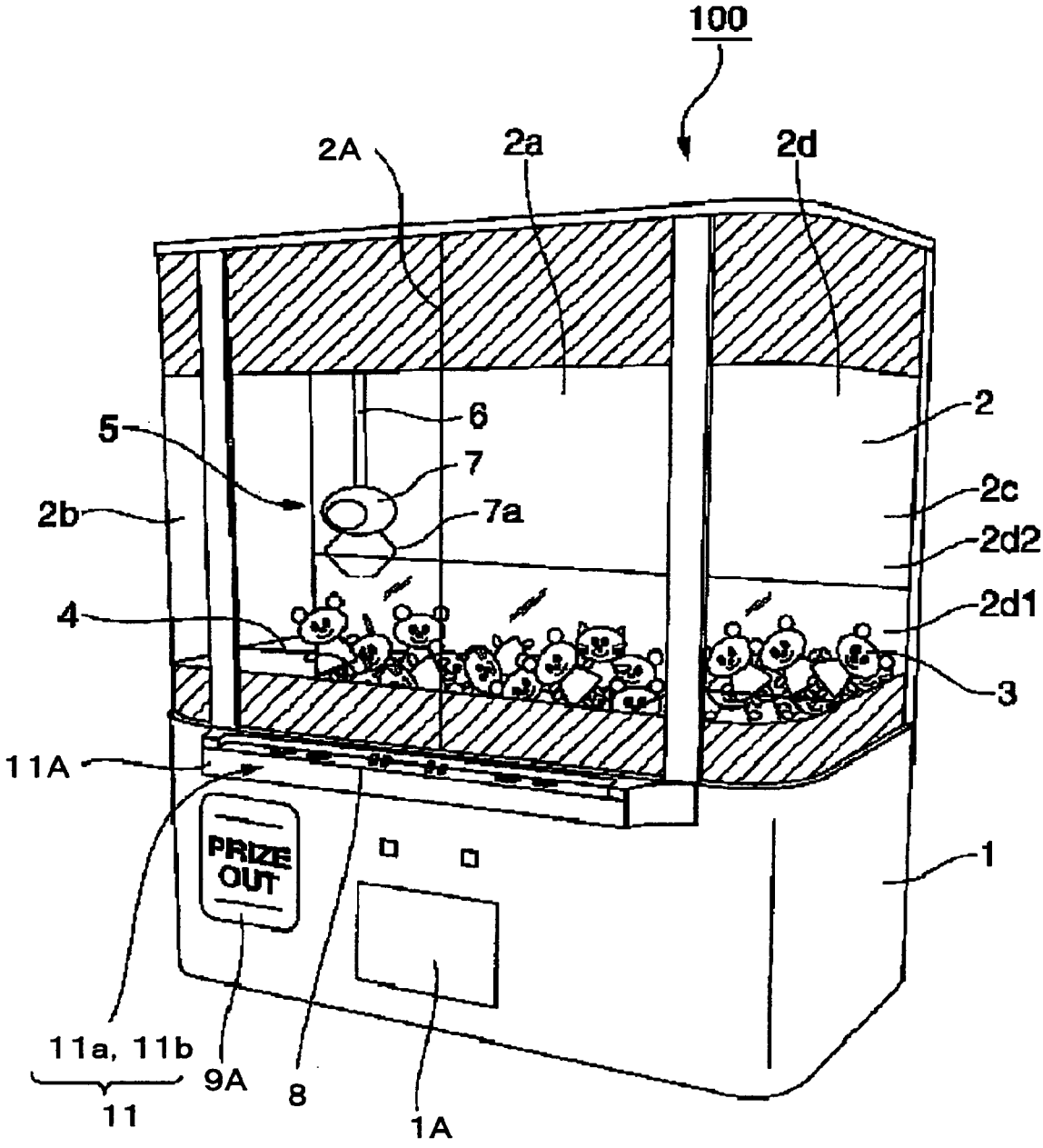
FIG. 1 is a perspective view showing one example of an appearance of a prize acquiring game apparatus according to the present invention.

FIG. 1 is a perspective view showing one example of an appearance of a prize acquiring game apparatus according to the present invention.

A prize acquiring game apparatus 100 is provided with a box-shaped prize storage section 2 on a pedestal 1 of rectangular parallelepiped, and a front surface 2*a* and side surfaces 2*b* and 2*c* of the prize storage section 2 are made of a transparent resin or glass plate-shaped member. As to a rear surface 2*d* of the prize storage section 2, its lower half portion 2*d*1 is made of mirror-surface plate-shaped member and its upper half portion 2*d*2 is made of a white plate-shaped member. When white is used for the rear surface 2*d* of the prize storage section 2 in such a manner, thereby producing a visual effect that the inside of the storage section becomes bright and prizes make a fine show. Further, since the lower half portion of the rear surface 2*d* is the mirror surface, prizes 3 arranged in a storage section are reflected on the mirror surface, thereby producing a visual effect such that a player sees more number of prizes than the actual number of the prizes. The mirror-surface portion does not have to be provided.

The front surface 2*a* of the prize storage section 2 is provided with a door 2A through which a shop clerk stores prizes, and the prizes 3 such as stuffed animals are stored in the prize storage section 2.

Further, a prize acquiring section 5 is hung from an internal upper surface of the prize storage section 2, and the prize acquiring section 5 is composed of a supporting section 6 made of an extendable pipe hung from the internal upper surface in a vertical direction, and a gripping section 7 provided on its lower end. The supporting section 6 is constituted so as to be capable of running on a fixed rail for lateral movement and a movable rail for vertical movement by a driving source such as a motor and be capable of expanding and contracting in an up-down direction. Further, the gripping section 7 is provided with two arms 7*a* for gripping the prizes 3 so that the arms 7*a* can be opened and closed. The two arms 7*a* are normally in the closed state, but when they grab the prizes, they open.

A bottom portion of the prize storage section 2 is provided with a cylindrical outlet 4 for discharging the prizes 3 in a vertical direction, and the prize 3 which falls into a frame body of the outlet 4 by the opening operation of the arms 7*a* passes through a passage connected to the frame body so as to be stored in a discharged prize storage section of the pedestal 1.

Meanwhile, the pedestal 1 is provided with an operation panel 11A which is operated by a player. The operation panel 11A has a button switch 11 for stopping the prize acquiring section 5 in a position corresponding to the desired prize 3 and a coin slot 8. In this example, the button switch 11 is composed of a first button switch 11*a* for stopping the prize acquiring section 5 to a predetermined position in a lateral direction (the lateral direction with respect to the player opposed to the game apparatus), and a second button switch 11*b* for stopping the prize acquiring section 5 whose predetermined position in the lateral direction is determined by the first button switch 11*a* to a predetermined position in a vertical direction (a depthwise direction with respect to the player opposed to the game apparatus).

A prize ejecting port covered with a prize ejecting cover 9A is provided below the operation panel 11A, and when the prize 3 acquired by the player is ejected, the prize ejecting cover 9A is opened so that the prize 3 is ejected from the prize ejecting port of the discharged prize storage section. An open/close door 1A is provided on a front surface of the pedestal 1, and interfaces (not shown) such as an operation button, an operation dial and a liquid crystal panel which are used by a shop manager to make various settings of the prize acquiring game apparatus 100 are provided inside the open/close door 1A. When the shop manager operates the operation button or the like to make various settings, a computer provided inside the pedestal 1 controls the prize acquiring game apparatus 100 based on the settings.

Figure 2:
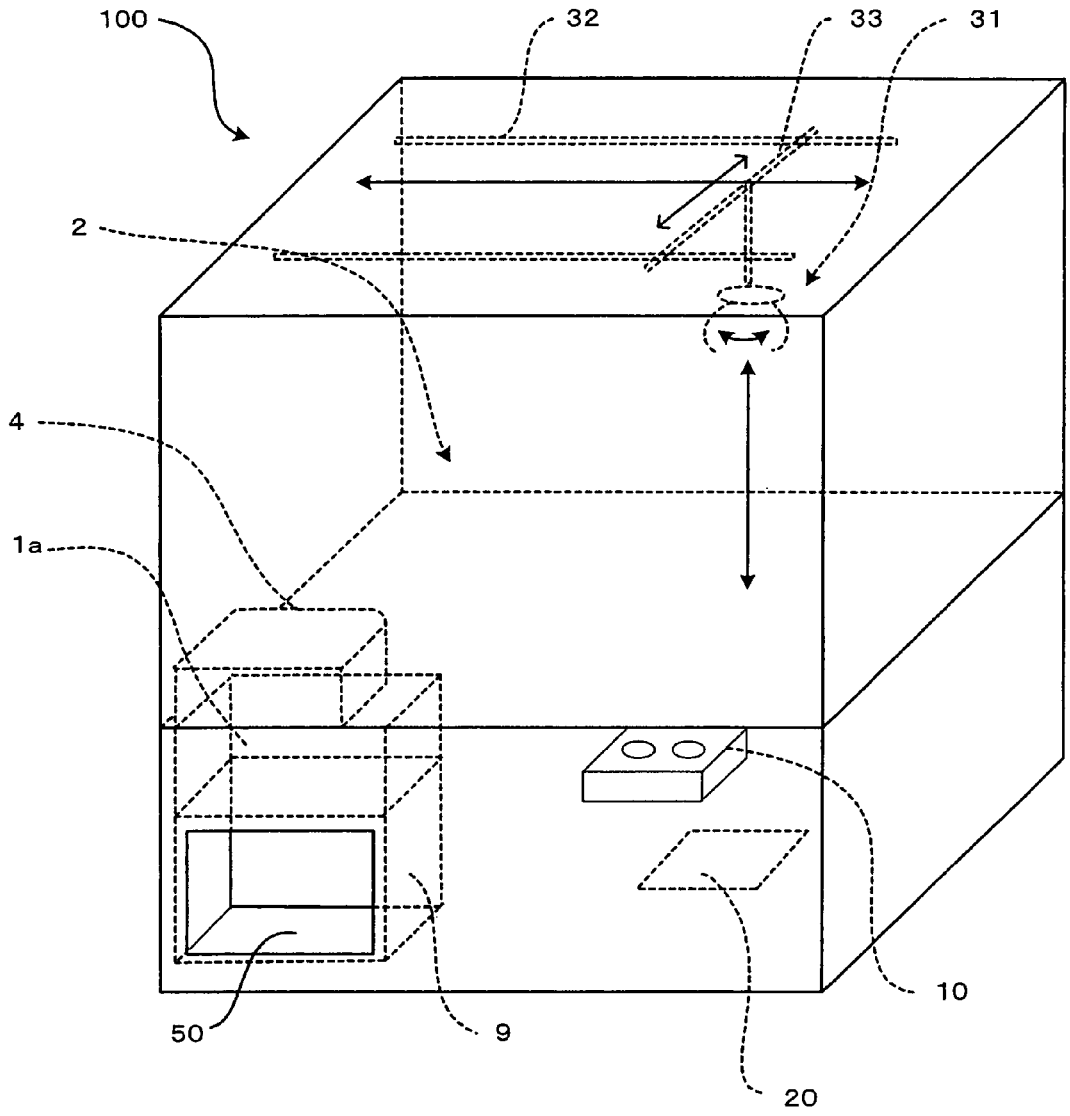
FIG. 2 is a pattern diagram showing a constitution of a main section of the prize acquiring game apparatus according to the present invention.
Figure 3:
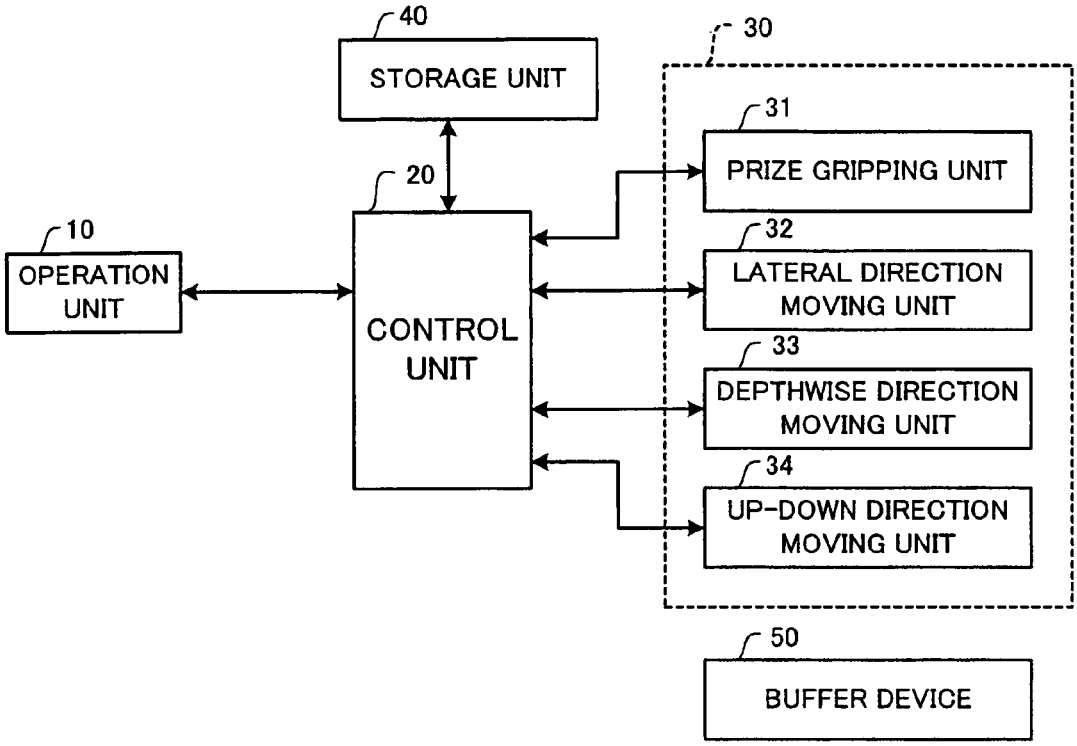
FIG. 3 is a block diagram showing a constitutional example of a control system of the prize acquiring game apparatus according to the present invention.

FIG. 2 is a pattern diagram showing a constitution of a main section of the prize acquiring game apparatus according to the present invention, and FIG. 3 is a block diagram showing a constitutional example of a control system of the prize acquiring game apparatus.

The prize acquiring game apparatus 100 has operation means 10 operated by a player, prize acquiring means 30 that acquires a prize stored in a space of the prize acquiring section 2, control means 20 that controls an operation of the prize acquiring means 30 in response to an operation signal from the operation means 10, and a storage unit 40 that stores an executing program and control data of the prize acquiring game, information about a number of the prizes acquired by a player and the like. Buffer means (shock-absorbing means) 50 that absorbs impact of a prize to fall into the discharged prize storage section via the passage 1*a* in the pedestal 1 from the outlet 4 is provided as a characteristic component, but it is not included in the control system in this embodiment. Hardware structures and basic functions of the respective units are explained below.

The operation means 10 is composed of operation buttons for stopping the prize acquiring section 5 in a position corresponding to the desired prize 3 in FIG. 1 (the first and second button switches 11*a* and 11*b* in FIG. 1) and the like.

The prize acquiring means 30 has a prize gripping unit 31 that grips a prize stored in the prize storage section, a lateral direction moving unit 32 that moves the prize gripping unit 31 to the lateral direction with respect to the player opposed to the game apparatus, a depthwise direction moving unit 33 that moves the prize gripping unit 31 to the depthwise (vertical) direction, and an up-down direction moving unit 34 that moves the prize gripping unit 31 to the up-down direction.

The lateral direction moving unit 32 and the depthwise direction moving unit 33 are composed of a guide mechanism for moving the gripping section 7 to a corresponding direction (the fixed rail for lateral movement, the movable rail for vertical movement and the like), a driving source (motor or the like), and a movement limit position detecting sensor for avoiding a contact of the prize 3 gripped by the arms 7*a* with a wall portion of the prize storage section 2 (a sensor such as an optical sensor, a limit switch or a magnetic sensor for detecting a position or distance). The up-down direction moving unit 34 is composed of a supporting mechanism having the extendable supporting section 6 that supports the gripping section 7 with a hook, a driving source (motor or the like) that extends the supporting section 6 so as to move the gripping section 7 to the up-down direction, and a movement limit position detecting sensor that detects a movement limit position in a low position (the sensor such as an optical sensor, a limit switch or a magnetic sensor for detecting a position or a distance).

The prize gripping unit 31 is composed of the gripping section 7 having the arms 7*a* which can grip a prize and can release, the driving source (motor or the like) that opens/closes the arms 7*a*, an arm angle detecting sensor that detects an open/close state of the arms 7*a*, and a prize release detecting sensor (for example, a weight detecting sensor that detects a weight on the gripping section 7). The arm angle detecting sensor and the prize release detecting sensor are used for, for example, detecting an abnormal state such that when the arms 7*a* are opened in a position of the outlet 4 so that a prize falls, the prize is caught between the arms 7*a* so as not to fall, if such a state occurs.

The control means 20 is composed of a CPU and the like, and moves the gripping section 7 of the prize gripping unit 31 in the depthwise direction and the lateral direction inside the prize storage section in response to the operation signal from the operation means 10 and locates it in the horizontal direction. The control means 20 controls the located gripping section 7 so as to allow it to lower automatically and the arms 7*a* to be closed. After the control means 20 automatically raises the arms 7*a* in the closed state to a predetermined height, the control means 20 moves the gripping section 7 to the horizontal direction so as to locate it in the position of the outlet 4 provided on the bottom portion of the prize storage section, and controls the automatic opening operation of the located arms 7*a*.

Further, the control means 20 detects an abnormal state such that a prize is not released from the arms 7*a* in the opened state based on detected signals from the arm angle detecting sensor and the prize release detecting sensor, and when the control means 20 detects the abnormal state, it repeats the open/close operation of the arms 7*a* or repeats the elevating operation of the supporting section at a high speed. As a result, the control means 20 makes a control so as to release the prize caught by the arms 7*a* so as to allow the prize to fall.

The buffer means 50 absorbs the impact of the prize to fall into the discharged prize storage section from the outlet 4, and in this embodiment, it is composed of a detachable buffer unit (cushion unit) having a thin plate-shaped elastic body having elasticity and a layer of thin plate shaped rigid bodies having rigidity. In a preferable embodiment, the buffer means 50 is constituted so that the thin plate shaped rigid body is laminated under a buffer layer constituted so that plural types of elastic bodies with different impact absorptive forces are laminated, and a bottom surface end of the rigid body is covered with one of the elastic bodies.

A concrete constitution of the buffer means 50 is explained in detail with reference to the drawings.

Figure 4A:
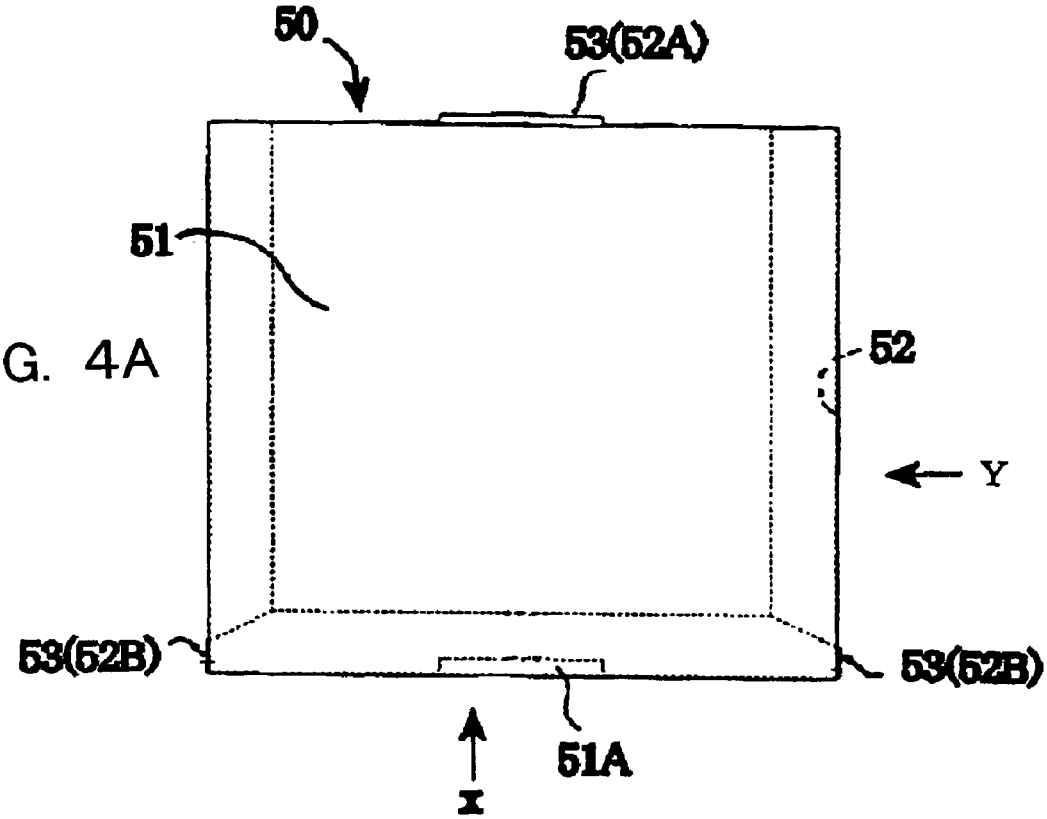
FIGS. 4A to 4C are a plan view, a front view and a side view showing a constitutional example of buffer means according to the present invention.
Figure 4B:
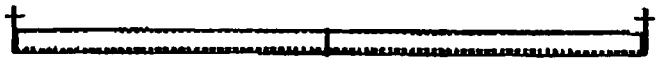
Figure 4C:
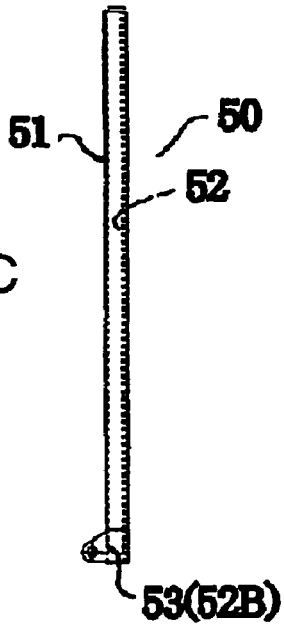
Figure 5:
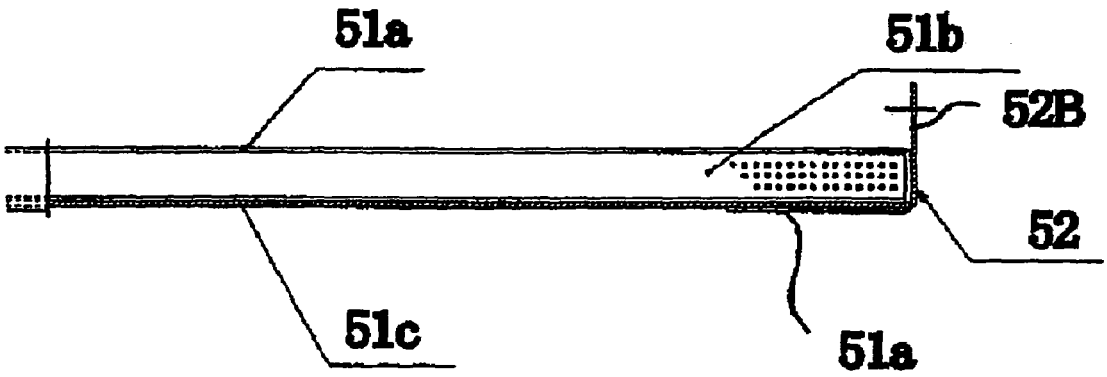
FIG. 5 is a partial sectional view showing a constitutional example of the buffer means according to the present invention.
Figure 6B:
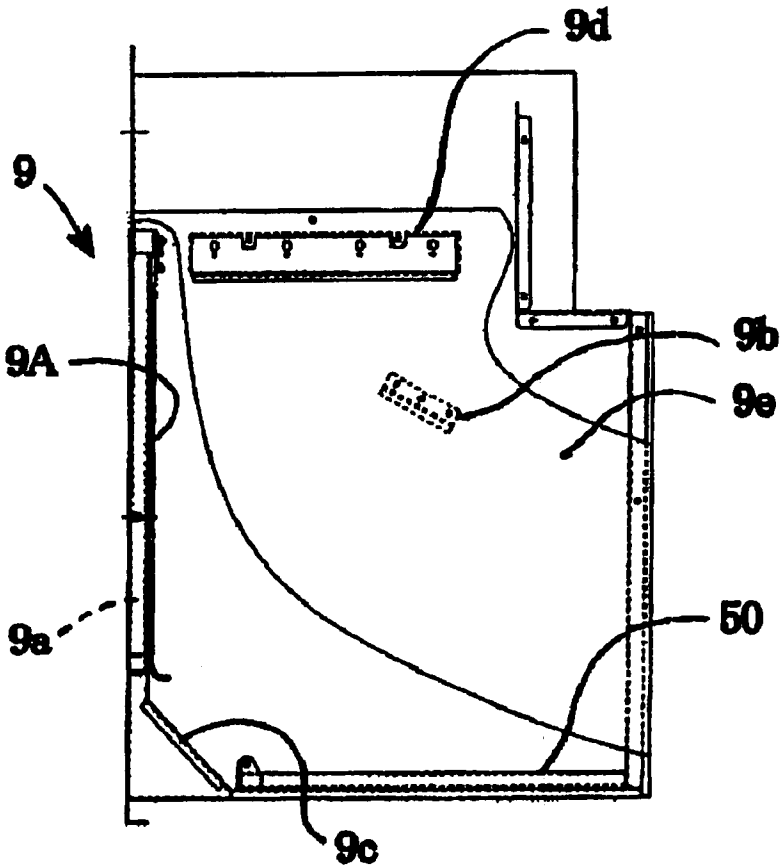
FIGS. 6A and 6B are a front view and a side view showing a constitutional example of a discharged prize storage section according to the present invention.
Figure 6A:
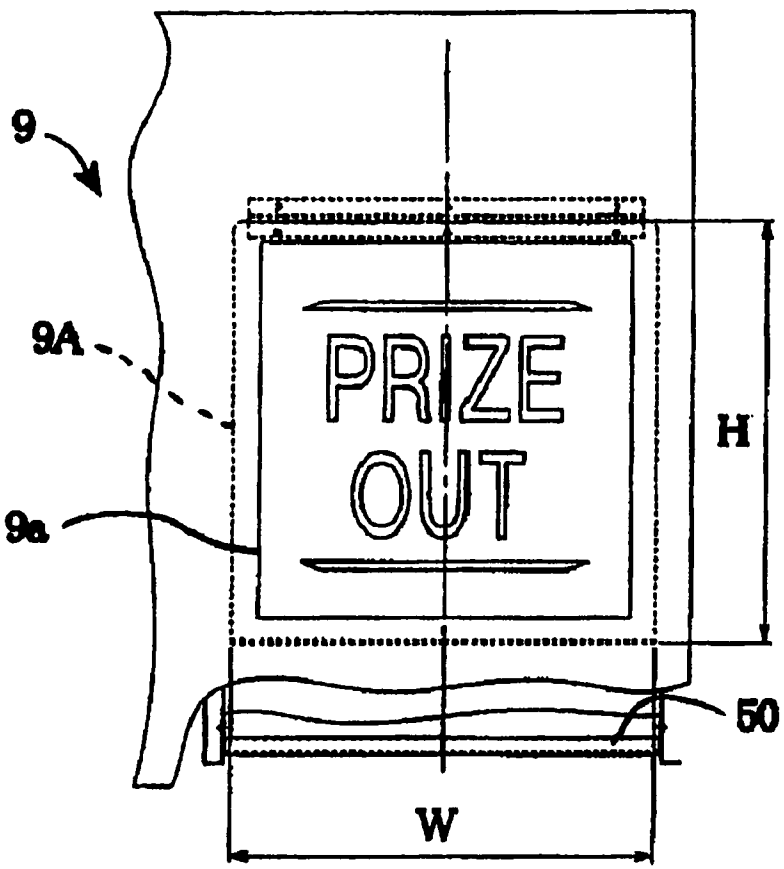

FIGS. 4A to 4C are diagrams showing constitutional examples of the buffer means. FIG. 4A is a plan view, FIG. 4B is a diagram viewed from a direction of an arrow X (front view), and FIG. 4C is a side view viewed from a direction of an arrow Y (right side view). FIG. 5 is a partial sectional view showing a constitutional example of the buffer means. FIGS. 6A and 6B are diagrams showing a constitutional example of the discharged prize storage section provided with the buffer means, FIG. 6A is a front view (diagram viewed from the side of the prize ejecting port), and FIG. 6B is a right side view.

The constitution of the discharged prize storage section provided with the buffer means is explained first. In the example of FIGS. 6A and 6B, the discharged prize storage section 9 has a cover body 9A, which covers an opening of the prize ejecting port 9*a* (in this example, the opening of a quadrate whose one side is about 330 mm) and can freely tilt at a predetermined angle to the back side using its upper side as an axis (prize ejecting cover: in this example, the rectangular cover body whose width W is 375 mm and whose height H is 369 mm). A member 9*b* (stopper) for limiting the tilt angle of the prize ejecting cover 9A is provided so as to tilt to right and left inner wall side surfaces of the storage section. The prize ejecting cover 9A in this example has a constitution such that it can tilt only to the back side as mentioned above in order to prevent a prize from dropping out of the opening of the prize ejecting port 9*a* to the outside and prevent the prizes in the prize storage section from being stolen by inserting a hand into the prize storage section. Further, the inner wall on the lower portion of the opening of the prize ejecting port 9*a* is provided with a tilt portion 9*c* having a tilt surface as shown in FIG. 6B in order to facilitate the ejecting of the prizes and the detachment of the buffer means 50. The inner wall upper portion of the discharged prize storage section 9 is provided with a prize detecting sensor 9*d* that detects a prize which falls. The prize detecting sensor 9*d* and the stopper 9*b* are mounted to a curved fixing member 9*e*, and have a detachable unit constitution.

The buffer means 50 of the present invention (hereinafter, "buffer unit") is provided detachably to a bottom portion of the discharged prize storage section 9 having the above constitution (a plane area on the backside of the tilt portion 9*c* in FIG. 6B).

In the example of FIGS. 4A to 4C, the buffer unit 50 is composed of thin plate shaped elastic body 51 and rigid body 52, and a fixing unit 53 that fastens and fixes the buffer unit 50 into the discharged prize storage section 9. The buffer unit 50 is formed into a shape according to a shape (in this example, rectangle) of the bottom surface portion (falling surface) of the discharged prize storage section 9 onto which a prize falls. The elastic body 51 of the buffer unit 50 has a notched portion 51A obtained by notching a part of an end of the elastic body 51. Meanwhile, the rigid body 52 of the buffer unit 50 is formed with a notched portion obtained by notching its one end (the notched portion to be engaged with the notched portion of the elastic body 51, not shown), and at least a part of the notched portion of the rigid body 51 is overlapped with at least a part of the notched portion of the elastic body 51 in a state that the rigid body 52 is overlapped with the elastic body 51. These notched portions (hereinafter, for convenience of the explanation, the notched portions of both the elastic body and the rigid body are "notched portions 51A") are used for detachment in order to facilitate the mounting/removal of the buffer unit 50 from the discharged prize storage section 9. In the embodiment, mentioned later, a second elastic body having a notched portion is layered under a first elastic body, and the first elastic body covers the notched portions 51A of the second elastic body and the rigid body 51. This embodiment explains the case where both the rigid body 52 and the elastic body 51 have the notched portion, but a first embodiment that only the rigid body 52 has the notched portion, a second embodiment that only the second elastic body has the notched portion, and a third embodiment that the both the rigid body 52 and the elastic body 51 have the notched portion like this embodiment are present.

The rigid body 52 of the buffer unit 50 is formed with a fitting portion 52A for fixing and a fixing section 52B so as to be capable of being fixed at a portion other than a falling area of prizes. The fitting portion 52A is formed into a convex shape to a plane direction at a center of the bottom end of the back side, and the fixing section 52B is formed on both ends of the front side by bending a part of the rigid body to the vertical direction. The fitting portion 52A and the fixing portion 52B are provided as the fixing unit 53. In this example, the fitting portion 52A of the rigid body 52 is fitted into a fitting portion (not shown) provided on the wall portion opposite to the prize ejecting cover 9A of the discharged prize storage section 9, and it is formed into a concave shape or a convex shaped (in this example, the convex shape). A locking tool may be provided instead of the fitting portion so that a locking tool on the side of the buffer unit 50 is locked with the locking tool on the side of the discharged prize storage section 9. The method of mounting/removing the buffer unit 50 to/from the discharged prize storage section 9 is mentioned later with reference to the drawings.

In the preferable embodiment, the elastic body 51 of the buffer unit 50 uses two elastic bodies with different impact absorptive force, and as shown in FIG. 5, first, second and third elastic bodies 51*a*, 51*b* and 51*c* are laminated on an upper surface of the rigid body 52. A peripheral edge of the first elastic body 51*a* having a plane area larger than a plane area of the rigid body 52 is bent as shown in FIG. 4A so that a lower portion of the first elastic body 51*a* contacts with the bottom portion (installation surface) of the discharged prize storage section 9. As a result, the edge portion of the first elastic body 51*a* covers the second elastic body 51*b* and the notched portion 51A formed on the rigid body 52, and the end portion (bottom surface peripheral edge or both ends) of the rigid body 52 is covered with the first elastic body 51*a*. In this example, a peripheral edge (front side and right and left ends) except for a portion on the back side of the rigid body 52 provided with the fitting portion 52A for fixing is covered with the first elastic body 51*a*.

The elastic body 51 of the buffer unit is constituted so that at least the first and the second elastic bodies 51*a* and 51*b* with different impact absorptive forces are laminated (in this example, the third elastic body 51*c* is further laminated). The rigid body 52 or the second elastic body 51*b*, or the rigid body 52 and the second elastic body 51*b* have a notched portion obtained by notching a part of the ends, and the first elastic body 51*a* which is overlapped with the upper portion of the second elastic body 51*b* covers a portion corresponding to the notched portion. In the case where both the rigid body 52 and the second elastic body 51*b* have the notched portion, the notched portion of the rigid body 52 and the notched portion of the second elastic body 51*b* are overlapped at least partially with each other in the state that the rigid body 52 is overlapped with the elastic body 51.

It is preferable that a buffer member with excellent in durability is used for the third elastic body 51*c* which is laminated on the first elastic body 51*a* which directly receives a falling prize and the elastic body 52, and a sponge like buffer member with excellent in impact absorptive force due to a deformation is used for the second elastic body 51*b* which indirectly receives a falling prize. Further, since the buffer unit 50 is constructed on the discharged prize storage section 9, as thickness of the buffer unit 50, thinner is better in order not to narrow the storage space. Further, it is desirable that the buffer members to be used are inexpensive.

In this embodiment, as a result of testing the impact absorptive force and the durability using various buffer members, it is the most desirable that a vinyl chloride leather sheet with a thickness of 1 mm is adopted for the first and the third elastic bodies 51*a* and 51*c*, and urethane sponge with a thickness of 10 mm (hardness: about 85 N) is adopted for the second elastic body 51*b*. FIG. 7 illustrates the test results. Impact values in FIG. 7 means impact values when a prize (weight: 275 g) is allowed to freely fall from a height of 950 mm (a distance from the arms 7*a* from which the prize falls to the bottom portion of the discharged prize storage section 9). The impact value in the case where the buffer unit 50 is not provided is 311 G, the impact value in the case where the buffer unit 50 with three layers is provided is 179 G, and the impact value in the case where the buffer unit 50 with two layers is 263 G. Further, in another test, when the vinyl chloride leather sheet with a thickness of 1 to 2 mm is combined with the urethane sponge with a thickness of 5 to 9 mm (two layers and three layers), all the impact values are about 300 G. The elastic body 51 (buffer layer) of the buffer unit 50 is not limited to the leather sheet made of vinyl chloride and urethane sponge, and an impact absorptive material such as a gel type impact absorptive material, an ultra flexible urethane material and non-resilient rubber may be used. In order to obtain the inexpensive constitution, however, it is desirable that the leather sheet made of vinyl chloride and the urethane sponge are used.

The elastic body 51 of the buffer unit 50 is composed of three layers including the first elastic body 51*a* composed of the leather sheet made of vinyl chloride with thickness of 1 mm, the second elastic body 51*b* made of urethane sponge (hardness: about 85 N) with thickness of 10 mm, and the third elastic body 51*c* composed of the leather sheet made of vinyl chloride with thickness of 1 mm (in this embodiment, the laser sheet made of vinyl chloride which is the same as the first elastic body). The rigid body 52 (in this embodiment, the plate shaped metallic member with thickness of 1.2 mm) is laminated below the first to the third buffer layers. In this embodiment, since the first elastic body 51*a* is bent to the bottom surface peripheral edge of the rigid body 52, the rigid body (metallic plate) 52 and the first elastic body 51*a* as a lower portion of the rigid body 52 function as a fourth buffer layer and a fifth buffer layer, and thus the impact at the time of falling of a prize is further absorbed. The elastic body which contacts with the bottom portion of the discharged prize storage section 9 is not formed by bending the first elastic body 51*a* but may be formed by using an independent elastic body. However, when the bending method is adopted, the manufacturing cost can be reduced. That is to say, in the state that the first to the third elastic bodies 51*a* to 51*c* are overlapped on the rigid body 52, the first elastic body 51*a* having an adhesive layer is laminated, and the first rigid body 51*a* is bent to the bottom surface side of the rigid body 52 as shown in FIGS. 4A and 5, so that the buffer unit 50 is completed.

When the buffer unit 50 having such a constitution is provided, breakables, goods whose surfaces are easily damaged and precision apparatuses which are easily failed by impact can be treated as prizes, and thus types of the prizes in the prize acquiring game apparatus can be greatly increased.

The method of detaching the buffer unit (mounting and removing method) is explained below with reference to FIGS. 8 to 11.

Figure 8:
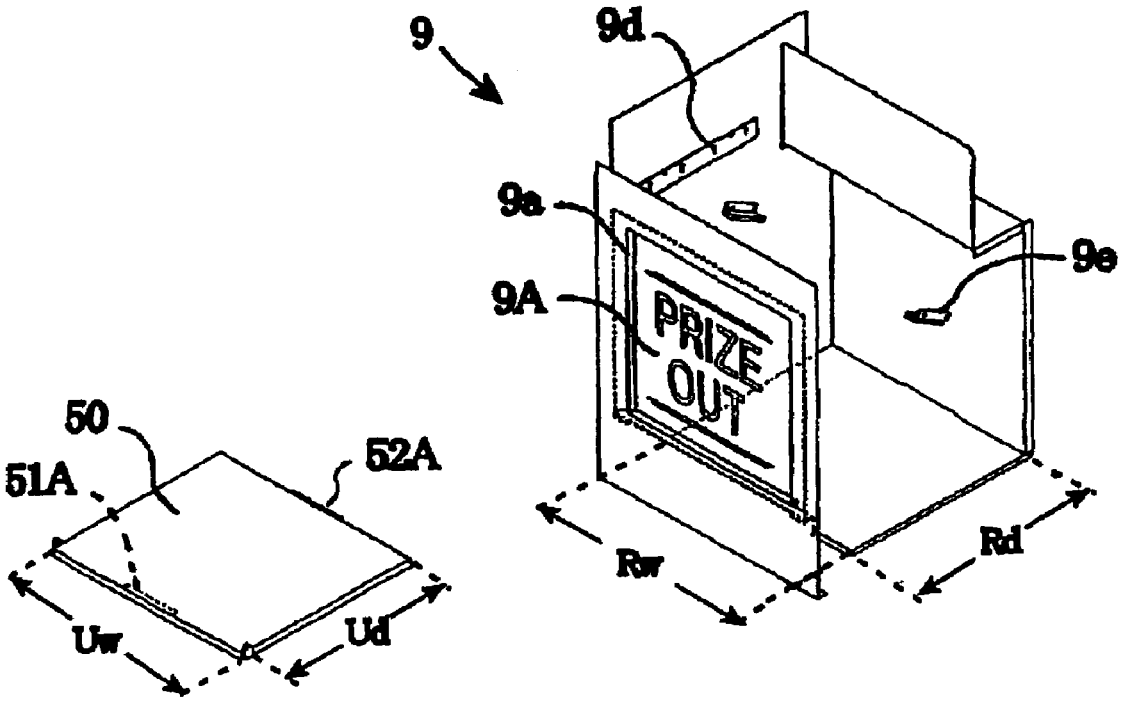
FIG. 8 is a first diagram for explaining a method of detaching a buffer unit according to the present invention.

FIG. 8 is a perspective view showing an internal constitution of the discharged prize storage section 9. A lateral width Uw and a depth Ud of the buffer unit 50 are approximately equal with a lateral width Rw and a depth Rd of the bottom portion of the discharged prize storage section 9 (in this example, Uw=388 mm, Ud=344 mm, Rw=390 nm, Rd=350 mm) in order to cover an approximately entire area of the prize falling portion. Meanwhile, a width Dw of the prize ejecting port 9*a* of the discharged prize storage section 9 (in this example, 375 mm) is narrower than the lateral width Rw of the bottom portion of the discharged prize storage section 9 and the lateral width Uw of the buffer unit 50.

Figure 9:
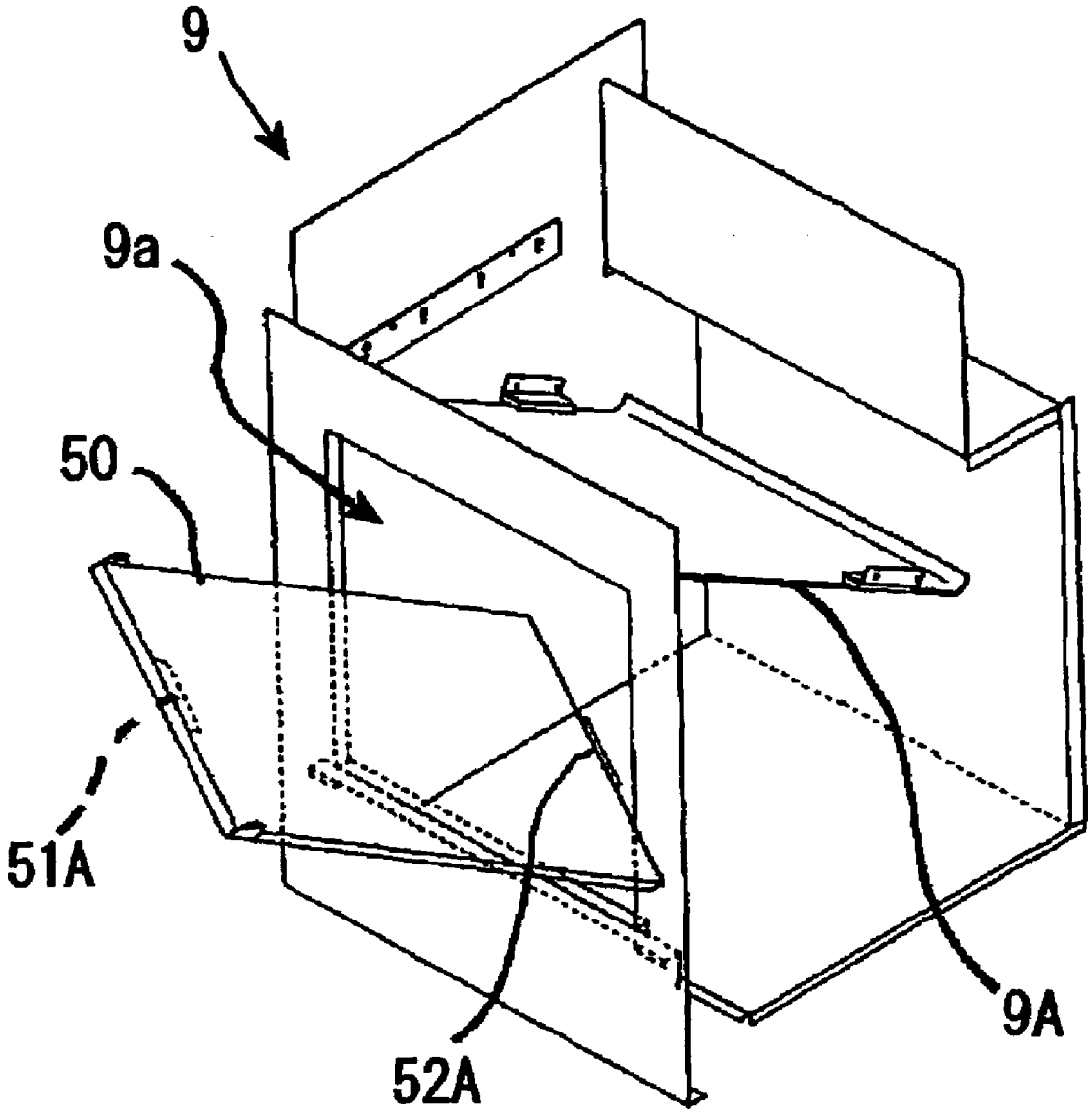
FIG. 9 is a second diagram for explaining the method of detaching the buffer unit according to the present invention.
Figure 10:
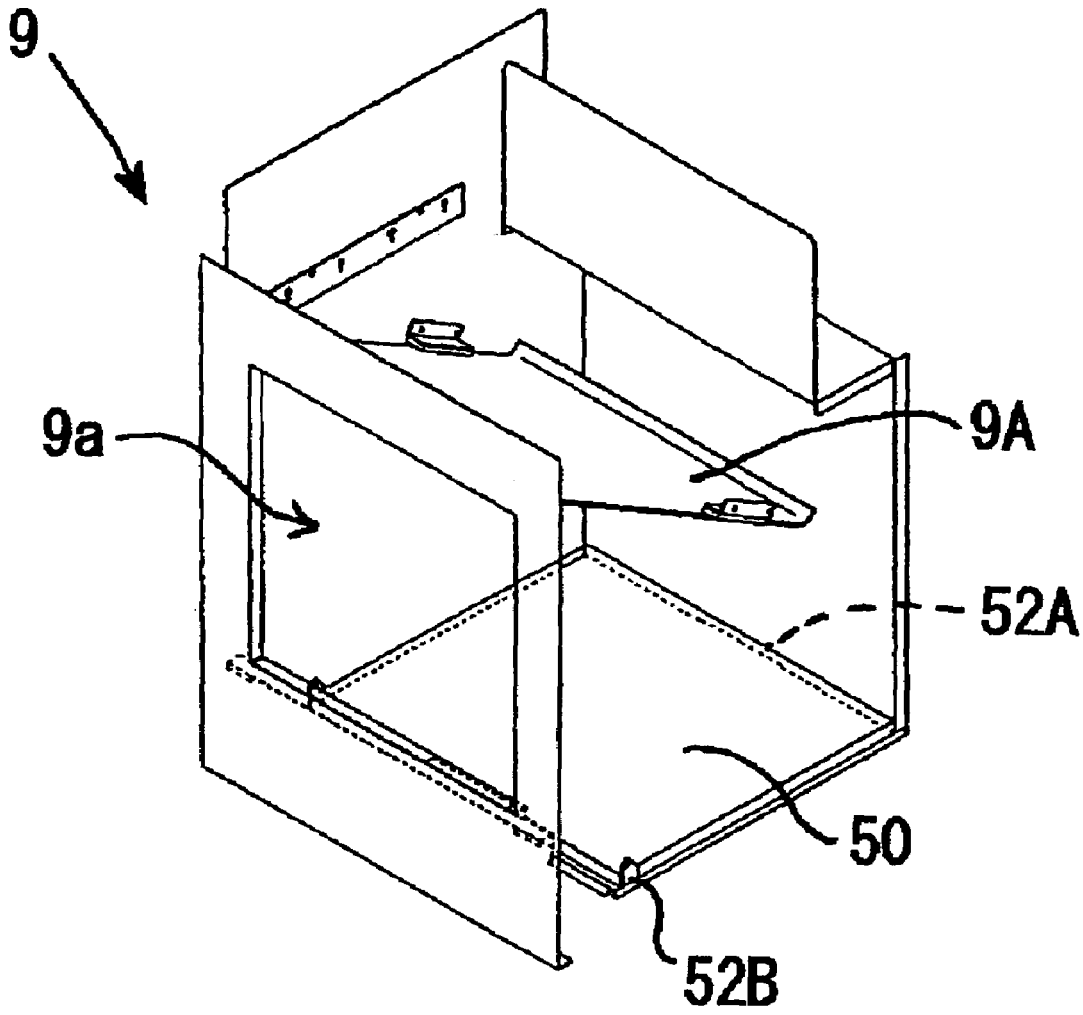
FIG. 10 is a third diagram for explaining the method of detaching the buffer unit according to the present invention.

When the buffer unit 50 is mounted to the discharged prize storage section 9 having the above constitution, in a state that the buffer unit 50 is horizontal as shown in FIG. 8, the buffer unit 50 cannot be put into the prize ejecting port 9*a*. As shown in FIG. 9, therefore, in a state that the prize ejecting cover 9A is pushed to the back side to be tilted, after the buffer unit 50 is tilted with respect to the horizontal plane so as to be put into the prize ejecting port 9*a*, the buffer unit 50 is returned to the horizontal state so as to be placed on the bottom portion of the discharged prize storage section 9 as shown in FIG. 10. At this time, since the tilt portion 9*c* is provided on the inner wall at the lower portion of the opening of the prize ejecting port 9*a* as shown in FIG. 6B, the buffer unit 50 slides along the tilt surface so as to be constructed on the bottom portion of the discharged prize storage section 9. At the same time, the fitting portion (in this example, a protruded portion) 52A for fixing which is formed on the back side of the buffer unit 50 is fitted into to be lock with the fitting portion of the discharged prize storage section 9. The buffer unit 50 is installed securely by the fixing portions 52B on both the ends of the front side of the buffer unit 50 (the inner wall of the storage section and screwing).

Figure 11:
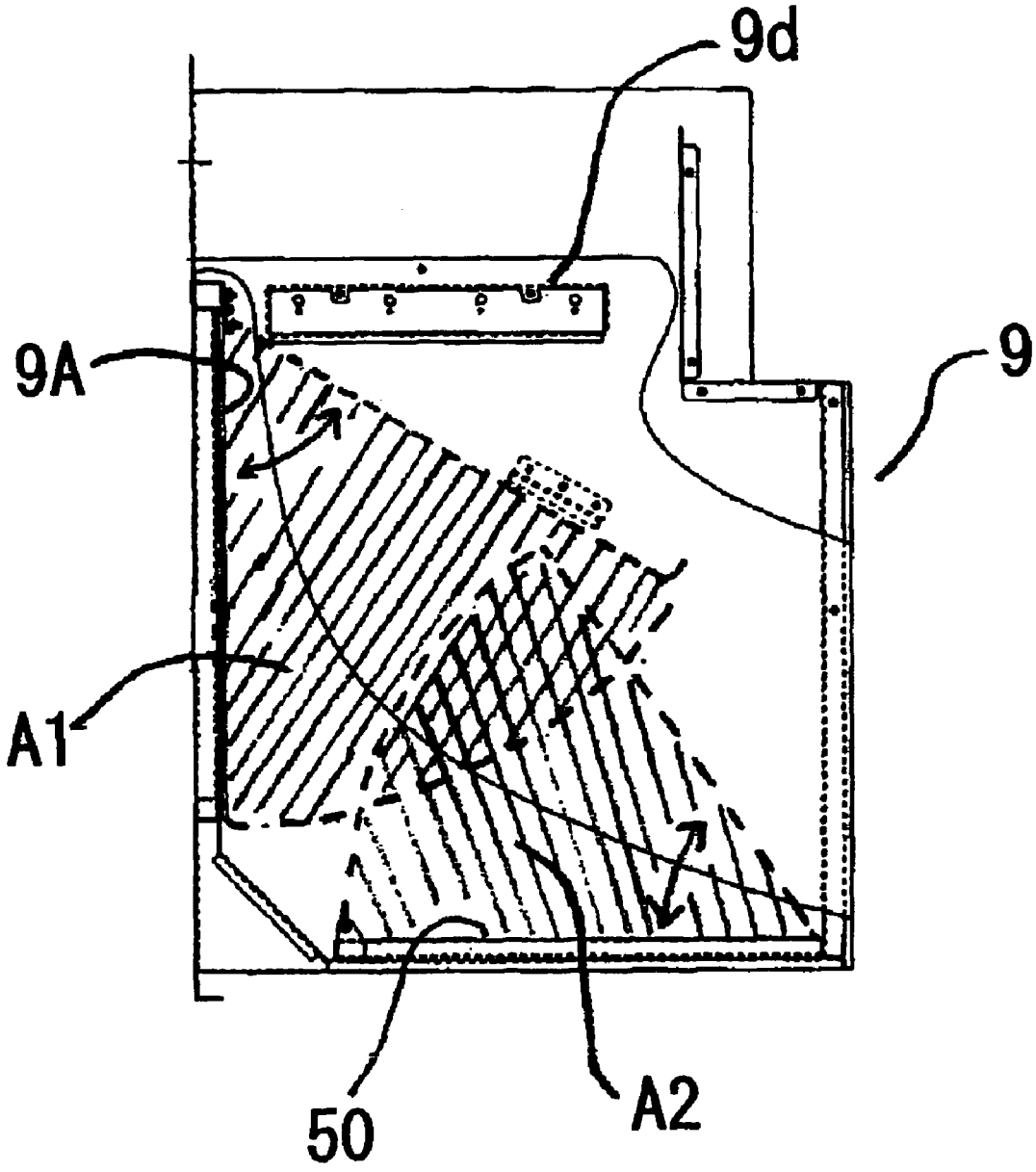
FIG. 11 is a fourth diagram for explaining the method of detaching the buffer unit according to the present invention.

On the other hand, when the buffer unit 50 is removed, in the state where the prize ejecting cover 9A is pushed to the back side to be tiled as shown in FIG. 10, the fixing state of the buffer unit 50 by means of the fixing portion 52B is released. A relationship between the buffer unit 50 and the prize ejecting cover 9A is explained with reference to FIG. 11. FIG. 11 is a pattern diagram showing a movable area of the buffer unit 50 and the prize ejecting cover 9A in the discharged prize storage section 9. The prize ejecting cover 9A can be tilted at a predetermined angle towards the back side using the upper end of the prize ejecting port 9*a* as an axis, and the movable area of the prize ejecting cover 9A is a shaded area portion shown by a reference symbol A1 in FIG. 11. Meanwhile, in the case where the buffer unit 50 is tilted by pinching the notched portion of the unit using the back side of the storage section as an axis, the movable area of the buffer unit 50 is a shaded area portion shown by a reference symbol A2 in FIG. 11. After the fixing state of the buffer unit 50 is released, therefore, the notched portion of the buffer unit 50 is pinched and the front side is slightly lifted so as to be drawn out to the front side, and the fitting portion 52A is removed to be lifted. As shown in FIG. 9, the buffer unit 50 is tilted with respect to the horizontal plane so as to be taken out from the prize ejecting port 9*a*. The buffer unit 50 has the notched portion 51A and the fixing unit 53 for the detachment so that the mounting/removal of the buffer unit 50 from the discharged prize storage section 9 becomes easy. The fixing unit 53 of the buffer unit 50 (in this example, the fitting portion 52A and the fixing portion 52B of the rigid body 52) is provided to a portion other than the area where the prize falls, and the notched portion 51A for pinching at the time of the detachment of the unit is covered with the elastic body 51*a* as the prize fall surface. For this reason, the buffer unit 50 can be mounted without deteriorating the buffer function.

A fall distance adjusting function owned by the control means 20 of the prize acquiring game apparatus relating to the buffer function that reduces the impact of the prize at the time of fall is explained below.

In the present invention, the control means 20 as well as the buffer means 50 has the function that reduces the impact of the prize at the time of fall. In the prize acquiring game apparatus 100 shown in FIG. 1, when the prize 3 is allowed to fall from above the outlet 4 of the prize storage section 2, the control means 20 automatically lowers the gripping section 7 which grips the prize to a position near the outlet 4 and opens the arms 7*a*. When the control means 20 makes a control so that the fall distance becomes short so as to reduce the impact of the prize at the time of the fall. The position where the arms 7*a* is lowered is detected based on, for example, a detected signal from the movement limit position detecting sensor in the up-down direction moving unit 34 or a detected signal from the prize detecting sensor 9*d* provided to the discharged prize storage section 9. The prize detecting sensor 9*d* in the discharged prize storage section 9 is used for counting a number of the prizes acquired by a player, but in the prize acquiring game apparatus according to the present invention, it can be used also as the position detecting sensor at the time when the gripping section 7 is automatically lowered to the position near the outlet 4. The gripping section 7 can be lowered to the inside of the outlet 4 as the position where the gripping section 7 is lowered based on the detected signal from the prize detecting sensor 9*d*, but a difficulty level of the prize acquisition is reduced. For this reason, it is desirable that the detected signal from the movement limit position detecting sensor in the up-down direction moving unit 34 is corrected, and the position (height) of the outlet 4, for example, is used as a standard position in the vertical direction so that this position and a position of the prize maximum length come to the lower end of the arms 7*a*. Further, the lowering distance may be fixed, but the gripping section having the arms 7*a* is replaced according to sizes of prizes to be stored, and thus the gripping section 7 cannot be lowered to the position of the lower end of the arms 7*a* in the fixed case. The position of the movement limit position detecting sensor is adjusted when the gripping section is replaced. For this reason, when the detected signal from the movement limit position detecting sensor is utilized, the gripping section can be controlled to be lowered to the position of the lower end of the arms 7*a*.

In the embodiment where the prize detecting sensor 9*d* is provided, the control means 20 includes an acquired prize counting function that counts the number of the prizes passed through the passage from the outlet 4 to the discharged prize storage section 9 based on the detected signal from the prize detecting sensor 9*d* so as to count the number of the prizes acquired by the player and store it in the storage unit 40. Information about the number of the prizes stored in the storage unit 40 is output to a display device so as to be displayed on a monitor for the player or is used as information for the difficulty level adjustment. For example, when the counted number of the acquired prizes exceeds a threshold value, the control means 20 corrects the lowering position of the gripping section 7 to an upper position with respect to the standard position, thereby reducing probability that the prizes enter the outlet 4, and thus the difficulty level may be automatically increased.

Figure 12:
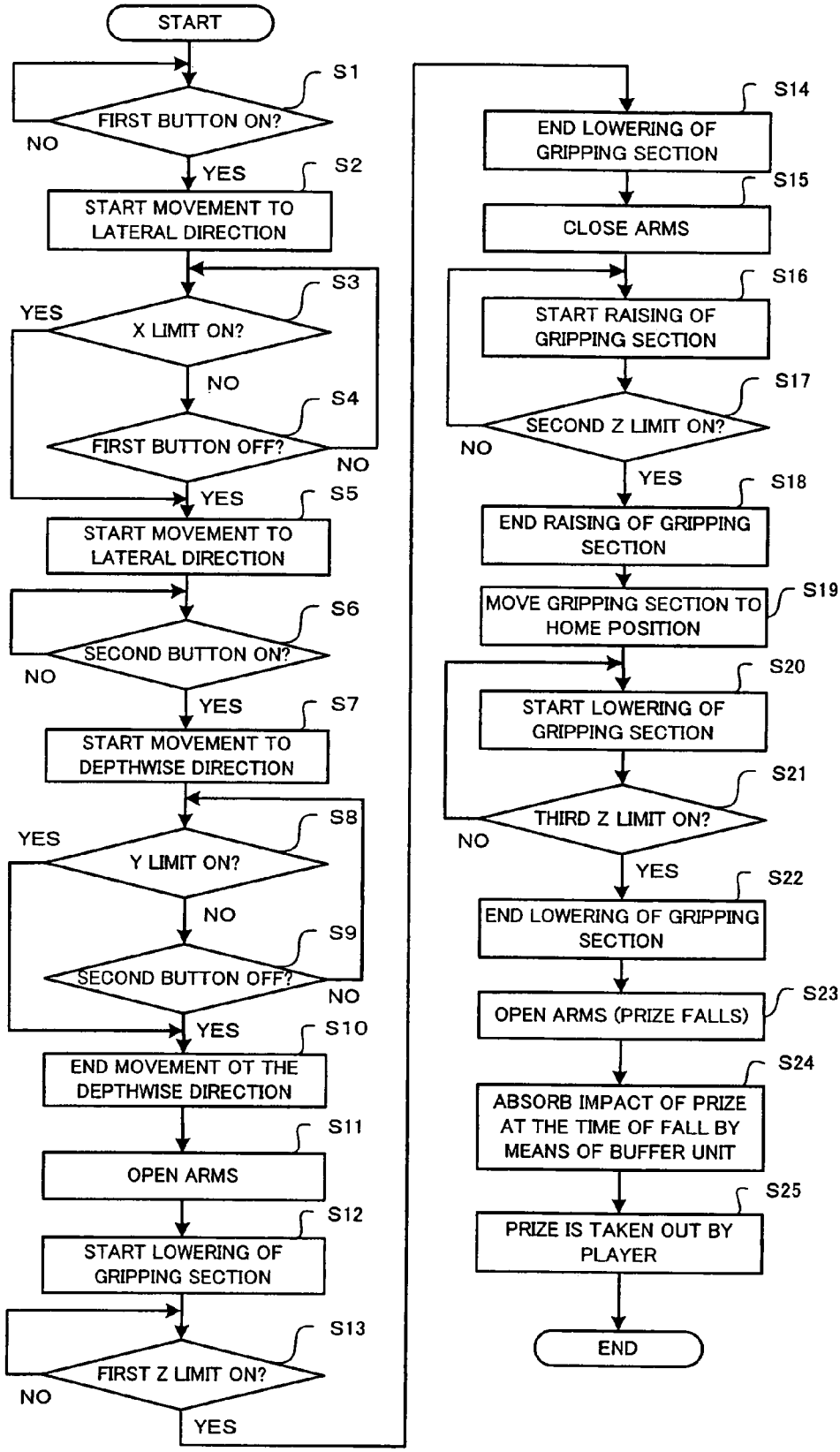
FIG. 12 is a flowchart showing an operation example of the prize acquiring game apparatus according to the present invention.

In the above constitution, an operation example of the prize acquiring game apparatus of the present invention is explained along a flow of the flowchart in FIG. 12.

Steps S20 to S22 are processes to be executed when the control means 20 has the fall distance adjusting function. Further, "X limit flag" to be used in the following explanation about the operation example is a flag representing that the gripping section 7 moves to the movement limit position in the lateral direction, and "Y limit flag" is a flag representing that the gripping section 7 moves to the movement limit position in the depthwise direction. "First Z limit flag" is a flag representing the movement limit distance in the downward direction when the player locates the gripping section 7 in the horizontal plane and allows the gripping section 7 to be automatically lowered, and "second Z limit flag" is a flag representing the movement limit distance in the upward direction. "Third Z limit flag" is a flag representing the movement limit distance in the downward direction when the gripping section 7 is located in a position just above the outlet 4 (hereinafter, "home position") and is automatically lowered. These flags are set by the control means 20 based on the detected signals from the corresponding sensors.

In the initial state, the prize acquiring section 5 is in the home position, and when the player puts a coin into the coin slot 8, the prize acquiring game apparatus 100 is brought into a game available state. The control means 20 of the prize acquiring game apparatus 100 determines whether the first button switch 11*a* is ON (step S1), and when it is ON, the driving source of the lateral direction moving unit 32 is operated so that the prize acquiring section 5 is moved to the lateral direction (step S2). The control means 20, then, determines whether the X limit flag is ON (step S3), and when it is not ON, the control means 20 determines whether the first button switch 11*a* is OFF (step S4). When the first button switch 11*a* is OFF, the operation of the driving source is stopped, so that the movement of the prize acquiring section 5 to the lateral direction is ended (step S5).

The control means 20 determines whether the second button switch 11*b* is ON (step S6), and when it is ON, the driving source of the depthwise direction moving unit 33 is operated so that the prize acquiring section 5 is moved to the depthwise direction (step S7). The control means 20 determines whether the Y limit flag is ON (step S8), and when it is not ON, determines whether the second button switch 11*b* is OFF (step S9). When the second button switch 11*b* is OFF, the operation of the driving source is stopped so that the movement of the prize acquiring section 5 to the depthwise direction is ended (step S10).

While the control means 20 is driving the motor in the gripping section 7 so as to open the arms 7*a* (step S11), it extends the supporting section 6 to the downward direction so as to start the lowering of the gripping section 7 (step S12). The control means 20 determines whether the first Z limit flag is ON (step S13), and when it is ON, ends the lowering of the gripping section 7 (step S14) so as to stop the motor and close the arms 7*a* (step S15). The arms 7*a* grip the desired prize 3.

The control means 20 shortens the supporting section 6 to the upward direction so as to start the raising of the gripping section 7 (step S16), and determines whether the second Z limit flag is ON (step S17). When the second Z limit flag is ON, the control means 20 ends the raising of the gripping section 7 (step S18). The control means 20 moves the prize acquiring section 5 to the home position (step S19). At the time when locating the prize acquiring section in the home position, the control means 20 operates the up-down direction moving unit 34 so as to lower the gripping section 7 to the position near the opening of the outlet (step S20). The control means 20 determines whether the third Z limit flag is ON (step S21), and when it is ON, the control means 20 determines that the gripping section 7 is lowered to the position near the opening of the outlet (step S22), so as to stop the motor and open the arms 7*a*. When the arms 3*a* grip the prize 3, the prize 3 is released by opening and closing the arms 7*a* so as to fall into the outlet 4. In the constitution having the prize release detecting sensor, the control means 20 determines whether the abnormal state such that the prize is caught between the arms 7*a* and does not fall occurs based on the detected signal from the sensor. When the abnormal state occurs, the control means 20 repeats the opening/closing operation at a number of times or repeats the moving operations of the gripping section 7 to the up-down direction and the right-left direction at a number of times so as to try a prize shaking-off process (step S23). The prize 3 which enters the outlet 4 falls via the passage connected to the frame body of the outlet 4 into the discharged prize storage section 9 so as to be stored therein. The passage provided on the lower portion of the frame body of the outlet 4 is formed by providing a cylindrical member for connecting the bottom portion of the outlet 4 to the top portion (opening) of the discharged prize storage section 9 in the vertical direction so that the prize discharged from the outlet 4 can reach the discharged prize storage section 9 in this example. At this time, the prize 3 falls on to the upper surface of the buffer unit 50 provided to the bottom portion of the discharged prize storage section 9, its impact is absorbed and the prize 3 is stopped on the buffer unit. In the embodiment where the prize detecting sensor 9*d* is provided, a prize which falls onto the buffer unit 50 is detected based on the detected signal from the sensor, the number of the prizes is counted so as to be stored in the storage unit 40 (step S24). The prizes stored in the discharged prize storage section 9 is taken out from the prize ejecting port 9*a* to the outside (step S25), and one game is ended.

The above flowchart explains the case where the home position matches with the position where a prize is allowed to fall (position above the outlet), but they do not have to be matched. In this case, at step next to the step S18, the prize acquiring section 5 is located in the position above the outlet 4, and the driving unit is driven so as to open the arms 7*a*. Thereafter, the arms 7*a* are closed so that the prize acquiring section 5 is moved to the home position. Further, in the case of the prize acquiring game apparatus which does not have the prize release detecting sensor 9*d*, the determining process for the abnormal state at step S20 and the prize shaking-off process can be omitted.

The above embodiment explains the case where the notched portion provided to the buffer unit is provided to both the elastic body and the rigid body, but it may be provided only to the elastic body. The above embodiment explains the game apparatus where a prize is gripped by the arms to be acquired as an example, but the apparatus is not limited to the prize acquiring form, and the present invention can be applied to any apparatuses which allows a prize in the housing to freely fall from the outlet into the storage section so as to discharge it out of the housing.

In the present invention, the fixing unit that fixes the buffer means to the discharged prize storage section is not limited to one that fastens a part of the rigid body composing the buffer means, the fixing unit may be a fixing unit that fixes a part of the elastic body in the rigid body and the elastic body composing the buffer means or a fixing unit that tightens both the elastic body and the rigid body composing the buffer means so as to fix them, or a fixing unit where fixing sections for fixing them individually are provided so as to fix them to the discharged prize storage section. Further, it is desirable that the buffer means is composed of the rigid body and the elastic body, but the buffer means including only the elastic body is included in the technical idea of the present invention. The fixing unit in this case is realized by fixing a part of the elastic body to the discharged prize storage section.

The buffer means of the present invention can be applied to an apparatus that acquires goods using a robot hand or the like and allows the goods to fall into a predetermined storage section so as to store them therein as well as the game apparatuses.

What is claimed is:

1. A prize acquiring game apparatus comprising:

a prize display chamber including a wall that is at least partially transparent and arranged to separate an internal space from outside of the game apparatus, a display floor having an expanse enough to display plural prizes, an outlet located at a portion of the display floor, and a prize-grabbing unit configured to move laterally and vertically in the internal space of the prize display chamber and to grab a prize when the prize-grabbing unit has moved downward to the display floor;

an operation means arranged outside of the prize display chamber;

a control means that controls the prize-grabbing unit to move laterally and vertically over the display floor in response to an operation signal from the operation means, and move over the outlet to release a prize if the prize-grabbing unit has successfully grabbed the prize; and a prize storage section including a bottom floor located at a bottom level of the prize acquiring game apparatus and a vertical passage arranged between the outlet and the bottom floor so as to allow a prize released from the prize-grabbing unit to fall down freely to the bottom floor, wherein the prize storage section further includes:

a take-out opening arranged along the vertical passage;

a cover door movably covering the take-out opening, the cover door being arranged to swing inwardly about an axis provided at an upper side of the take-out opening so as to block the vertical passage when the cover door is pushed up inwardly and to allow the prize to be recovered from the bottom floor; and a buffer unit removably disposed on the bottom floor, the buffer unit being formed of a lower layer of rigid material and an upper layer of buffering material formed on the lower layer of rigid material, wherein the upper layer of buffering material is formed of material having a buffering characteristic enough to absorb an impact caused by the prize which has fallen freely from the prize-grabbing unit, and wherein the lower layer of rigid material is formed of material having a hardness enough to firmly fit the buffer unit to the bottom floor of the prize storage section against an impact of the fallen prize.

2. The prize acquiring game apparatus according to claim 1, wherein the buffer unit has a size to fit to the bottom floor and is mountable to the bottom floor through the take-out opening while the cover door is pushed up inwardly.

3. The prize acquiring game apparatus according to claim 2, wherein a height from a position where the prize-grabbing unit releases a prize to the bottom floor is at least 950 mm.

4. A prize acquiring game apparatus comprising:

a prize display chamber including a wall that is at least partially transparent and arranged to separate an internal space from outside of the game apparatus, an outlet located inside the prize display chamber, and a prize-grabbing unit configured to move laterally and vertically in the internal space of the prize display chamber, to grab a prize when the prize-grabbing unit has moved downwardly to a level at which the prize is displayed, and to release a prize to the outlet if the prize-grabbing unit has successfully caught the prize;

an operation means arranged outside of the prize display chamber;

a control means that controls the lateral and vertical movement of the prize-grabbing unit when triggered by an operation on the operation means, and the grabbing and releasing movement of the prize-grabbing unit; and a prize storage chamber having a bottom floor located at a bottom level of the prize acquiring game apparatus and a passage arranged between the outlet and the bottom floor so as to allow a prize released from the prize-grabbing unit to move down to the bottom floor, said passage including a vertical passage through which the prize falls down freely to the bottom floor, wherein the prize storage chamber further comprises:

a take-out opening arranged along the vertical passage;

a cover door movably covering the take-out opening, the cover door being arranged to swing inwardly about an axis provided at an upper side of the take-out opening so as to block the vertical passage when the cover door is pushed up inwardly and to allow the prize to be recovered from the bottom floor; and a buffer unit removably disposed on the bottom floor, the buffer unit including a buffering layer formed at an upper face of the buffer unit and a rigid material lining the buffering layer, the buffering layer being enough to absorb an impact caused by the fallen prize and the rigid material having a hardness enough to firmly fit the buffer unit to the bottom floor of the prize storage section against the impact of the fallen prize.

* * * * *